United States Patent [19]

Reilly et al.

[11] Patent Number: 4,967,089

[45] Date of Patent: Oct. 30, 1990

[54] PULSED OPTICAL SOURCE

[75] Inventors: David M. Reilly, Boxborough; Anthony M. Nicoli, Brighton, both of Mass.; Richard G. Schulze, Hopkins; Barbara L. Goldenberg, Minneapolis, both of Minn.

[73] Assignee: Honeywell Inc., Minneapolis, Minn.

[21] Appl. No.: 122,820

[22] Filed: Nov. 19, 1987

[51] Int. Cl.[5] ..... H01J 43/00

[52] U.S. Cl. ..... 250/493.1; 250/496.1; 250/504 R; 313/534; 313/539; 357/30

[58] Field of Search ..... 150/493.1, 496.1, 504 R; 313/539, 534; 357/30

[56] References Cited

U.S. PATENT DOCUMENTS

| | | | |
|---|---|---|---|
| 3,355,616 | 11/1967 | Hecker et al. | 313/534 |
| 3,423,624 | 1/1969 | Steiner | 313/539 |
| 4,131,818 | 12/1978 | Wilder | 313/534 |
| 4,156,822 | 5/1979 | Shelton et al. | 313/534 |
| 4,264,811 | 4/1981 | Tanaka | 313/534 |
| 4,286,148 | 8/1981 | Kamps et al. | 313/534 |
| 4,339,659 | 7/1982 | Johnson | 313/534 |
| 4,393,322 | 7/1983 | Siegmund | 313/534 |
| 4,481,531 | 11/1984 | Warde et al. | 313/534 |
| 4,614,871 | 9/1986 | Driscoll | 313/539 |
| 4,614,961 | 9/1986 | Khan et al. | 357/30 |
| 4,616,248 | 10/1986 | Khan et al. | 357/30 |
| 4,691,099 | 9/1987 | Johnson | 313/534 |

*Primary Examiner*—Jack I. Berman
*Assistant Examiner*—Kiet T. Nguyen
*Attorney, Agent, or Firm*—Haugen and Nikolai

[57] ABSTRACT

A compact pulsed optical source of near to ultraviolet wavelength energy adapted to be connected to an external power source. The optical source includes a device for emitting photons, apparatus for transforming photons into photoelectrons, apparatus for multiplying the photoelectrons, a lens, a phosphor coated anode, circuit apparatus for providing a pulsed electric signal and first and second biasing apparatus. The emitting device impinges photons on the photon transforming apparatus which accelerates electrons to the multiplying apparatus as pulses are received from the circuit apparatus which relates the multiplying apparatus to the transforming apparatus. With each pulse, a cloud of electrons is emitted from the multiplying apparatus and excites the phosphor coated anode thereby causing optical emission.

27 Claims, 2 Drawing Sheets

PULSED OPTICAL SOURCE

BACKGROUND OF THE INVENTION

1. Field of the Invention.

This invention relates generally to an optical source in the near and middle ultraviolet wavelengths and more particularly, to a compact pulsed optical source having an emission wavelength in the range of 220 nm to 360 nm.

2. Discussion of the Prior Art.

This invention provides a compact, rugged, pulsed optical source. In a related area, ultraviolet photocathodes and tuneable cutoff ultraviolet detectors have been developed by Honeywell Inc. based on aluminum gallium nitride ($Al_x Ga_{l-x}N$) technology. These inventions have been disclosed in United States Pat. Nos. 4,614,961 and 4,616,248 the teachings of which are hereby incorporated into this specification by reference.

SUMMARY OF THE INVENTION

A pulsed optical source of near and ultraviolet wavelength energy, adapted to be connected to an external power source is disclosed. The source includes means for emitting photons, and means for converting photons into photo-electrons. The photon converting means is disposed to receive photons emitted from the photon emitting means. The source further includes means for multiplying and emitting the photo- electrons in the form of a pulsed cloud of electrons. The multiplying and emitting means has input and output terminals and is disposed to receive electrons from the photon converting means. Means for converting electrons into photons, is disposed to receive the pulsed cloud of electrons from the multiplying and emitting means. Means for accelerating the cloud of electrons from the multiplying and emitting means to the electron converting means is included. The accelerating means has a first terminal and a second terminal wherein the first terminal is at a more negative electrical potential than the second terminal, and the first terminal is connected to the output terminal of the multiplying and emitting means and the second terminal is connected to the electron converting means so that the emitted pulsed cloud of electrons is accelerated to the electron converting means. Further included is a means for controlling the duty cycle of the multiplying and emitting means having a first terminal connected to the input terminal of the multiplying and emitting means and a second terminal connected to the photon converting means. Finally, a biasing means is included having a first terminal and a second terminal wherein the first terminal is at a positive electrical potential with respect to the second terminal, and the first terminal is connected to the output terminal of the multiplying and emitting means and the second terminal is connected to the input terminal of the multiplying and emitting means.

BRIEF DESCRIPTION OF THE DRAWINGS

For a more complete understanding of the invention, reference is hereby made to the drawings in which.

DESCRIPTION OF THE PREFERRED EMBODIMENT

Figure 1:
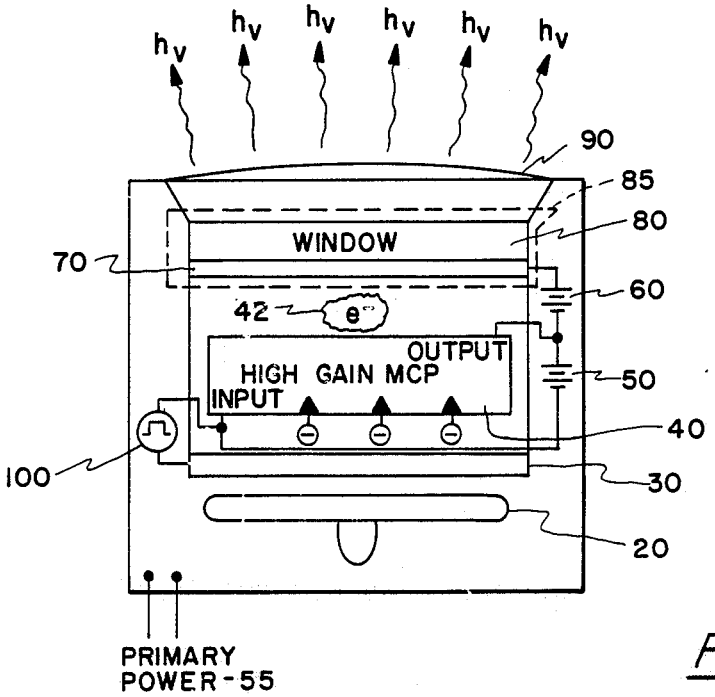
FIG. 1 shows a schematic view of one embodiment of a compact pulsed optical source.

Referring now to FIG. 1, a schematic view of one embodiment of a pulsed optical source is shown. The source is adapted to be connected to an external primary power source 55. The source further includes means for emitting photons 20, means for converting photons into photoelectrons 30, means for multiplying and emitting electrons 40, a biasing means 50, means for accelerating electrons 60, means for converting electrons into photons 85, and means for focusing the photons 90. The photon converting means 30 is disposed to receive photons emitted from the photon emitting means 20.

The means for emitting photons 20 is preferably a self-energizing source such as a low level radiation tritium activated phosphor. Such sources are commercially available and are packaged as chambers filled with tritium gas and coated with an appropriate phosphor well known to those skilled in the art. The photon emitting means 20 is disposed such that photons are emitted and impinge upon converting means 30. Photon converting means 30 is advantageously a photocathode which is itself disposed in such a way as to emit electrons which impinge upon the multiplying and emitting means 40.

The multiplying and emitting means 40 is electronically related to the transforming means 30 through duty cycle means 100. In the embodiment of FIG. 1, duty cycle means 100 is connected at a first terminal to transforming means 30 and at a second terminal to the input of the multiplying and emitting means 40. Duty cycle means 100 provides a pulsed electric signal such that the voltage potential of the multiplying and emitting means 40 is pulsed to a higher potential at its input than the photon converting means 30, thereby accelerating electrons into the multiplying and emitting means and exciting the multiplying means 40 to accelerate a cloud of electrons 42 towards the anode 70, an appropriate phosphate. When the multiplying and emitting means is pulsed "on", a large quantity or cloud of electrons 42 in the range of about $10^6$ to $10^7$ electrons are emitted from the multiplying and emitting means 40. The pulsed cloud of electrons 42 impinging on the anode 70 excites the phosphor, causing optical emission of photons into the window 80 and through the focusing means 90 in the form of temporally narrow pulses at relatively low repetition rates.

A biasing means 50 is connected at a positive terminal to the output terminal of multiplying and emitting means 40 and at the negative terminal to the input of multiplying and emitting means 40. The multiplying and emitting means 40 is preferably a high gain microchannel plate electron multiplier (MCP).

Means for converting electrons to photons 85 is located in a suitable position for receiving the cloud of electrons 42 from multiplying and emitting means 40. The electron converting means 85 is further comprised of anode 70 and window 80.

Means for accelerating the electrons 60 is preferably a voltage source having a positive voltage terminal and a negative voltage terminal. The positive voltage terminal of accelerating means 60 is connected to anode 70 and the negative voltage terminal is connected to the output terminal of multiplying and emitting means 40. Therefore, the output of multiplying and emitting means 40 remains at a negative potential with reference to the anode 70 so that the cloud of electrons 42 is accelerated to the converting means 85.

The selected phosphor used for the anode 70 may be any "fast" phosphor with the resulting optical energy being emitted from the source being at any wavelength from the vacuum ultraviolet to the infrared wavelength. One such fast phosphor is an alloy composition of $Al_x Ga_{l-x}N$. The phosphor is grown onto the surface of a window 80 which is preferably a basal plane sapphire ($Al_2O_3$) substrate. The combination of the phosphor 70 and the window 80 resulting in electron converting means 85 may advantageously be a phosphor coated anode embodiment similar to the devices disclosed with reference to FIGS. 3 and 4 as discussed below. The biasing means 50 may be a voltage source having a potential voltage drop of preferably about 1000 to 2500 volts and the accelerating means 60 may be a voltage source having a potential drop of about 500 to 5000 volts. If $Al_x Ga_{l-x}N$ is used, the thickness of the phosphor of anode 70 is preferably in the range of about 100 nm to 1000 nm. In an alternate embodiment of the invention, a film of AlN may be applied to the inside surface of the window and the layer of $Al_x Ga_{l-x}N$ is then applied over the film of AlN. The film of AlN may preferably be very thin, on the order of 0.1 micron.

Duty cycle means 100 for producing a pulse may comprise any conventional pulsing circuitry well known to those in the art. The pulsed electric signal pulses the input terminal of multiplying means 40 to a higher potential voltage than the photon converting means 30. The pulse preferably has an amplitude of about 200 volts, a pulse width in the range of about 100 ns to 1000 ns and a repetition rate in the range of about 10 to 100 pps.

Figure 2:
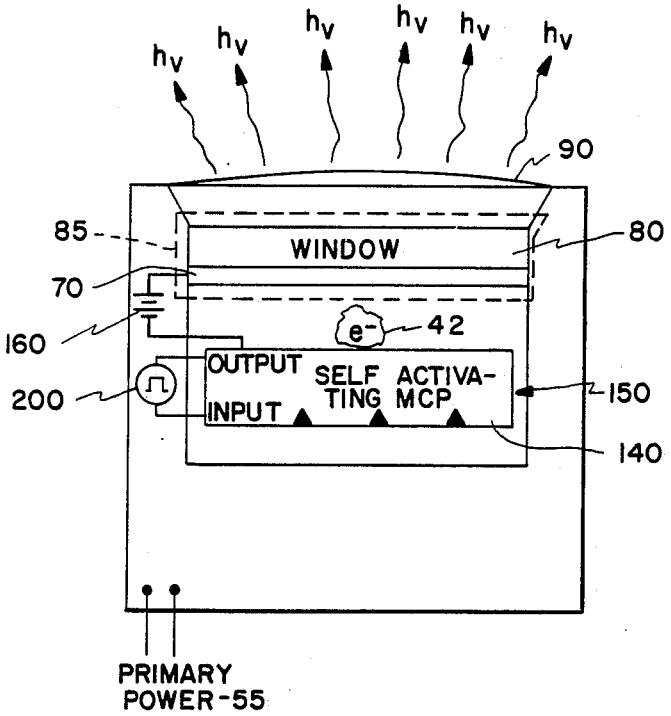
FIG. 2 is a schematic view of one embodiment of a pulsed optical source including a self-activating means for emitting electrons.

Referring now to FIG. 2, a schematic view of another embodiment of a pulsed optical source including a self-activating means for emitting electrons is shown. The source includes means for emitting electrons 150 having input and output electrodes. Means 200 for controlling the duty cycle and quantity of electrons emitted from the emitting means 150. The duty cycle and controlling means 200 having a first terminal connected to the input electrode of the emitting means 150 and a second terminal connected to the output electrode of the emitting means 150. The emitting means 150 is turned "on" when the first terminal has a negative electrical potential with respect to the second terminal. When the emitting means is in the "on" mode, a large quantity or cloud of electrons 42 on the order of about $10^6$ to $10^7$ electrons are emitted as a temporally narrow pulse at relatively low repetition rates.

Means for converting electrons to photons 85 is located in a suitable position for receiving the cloud of electrons from emitting means 150. The electron converting means 85 being further comprised of anode 70 and window 80 as in the FIG. 1 embodiment. Anode 70 and window 80 may be comprised of materials having the same properties a described above with respect to FIG. 1. Means for accelerating the electrons 160 has a positive voltage terminal and a negative voltage terminal. The positive voltage terminal of accelerating means 160 is connected to anode 70 and the negative voltage terminal is connected to the output terminal of emitting means 150. Therefore, the output terminal of emitting means 150 remains at a negative potential with reference to the anode 70 so that the cloud of electrons 42 is accelerated to the converting means 85.

In one embodiment of the invention as depicted in FIG. 2, the means for emitting electrons 150 may suitably be an unstable microchannel plate which generates electrons internally. The means 200 for controlling the quantity of electrons emitted and the duty cycle may be any suitably adapted electronic pulsing circuit having parameters generally as described above with respect to duty cycle means 100 in FIG. 1, with the exception that the maximum pulse amplitude will range from 1000 to 2500 volts. The accelerating means 160 may be a voltage source suitably adapted to provide a positive electrical bias of about 200 volts between the converting means 85 and the emitting means 150. Finally, in FIG. 2, means for focusing the resultant photons 90 emitted from the converting means 85 may be provided.

This focusing means 90 may be any suitable optical lens or lens system well known to those in the art. It is believed that there may exist some applications for the invention which do not require the inclusion of focusing means 90.

With respect to the embodiments shown in both FIGS. 1 and 2, the window 80 is assembled by conventional optical assembly means to the focusing means 90. The focusing means 90 may comprise an optical quality lens which shapes and distributes the emitted radiation into space. The emission wavelength of the optical source using the $Al_x Ga_{l-x}N$ will be in the range of about 220 nm to 360 nm, depending upon the compound used for the phosphor. The spectral bandwidth of the source is advantageously in the range of about 10 to about 15 nm. The number of photons emitted from the optical source is advantageously in the range of about $10^{13}$ to $10^{15}$ per pulse. Peak energy of the optical source is advantageously in the range of about 50 to 500 joules.

Figure 3:
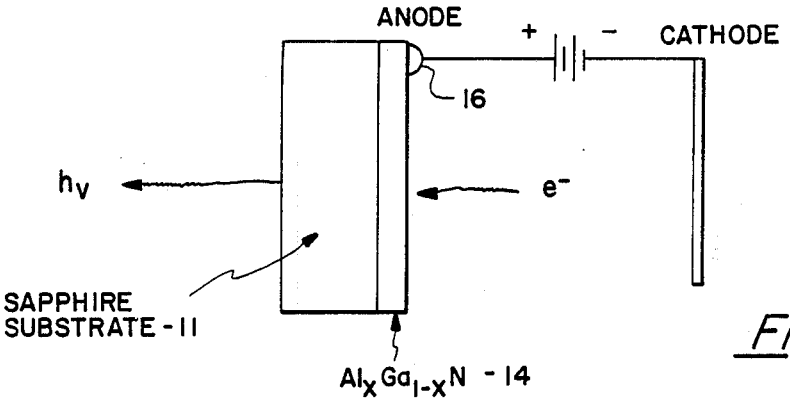
FIG. 3 is a schematic view of the layer structure of a device for producing photons in the ultraviolet wavelength from impinging electrons including a sapphire ($Al_2O_3$) substrate and a thin film epitaxial layer of $Al_x Ga_{l-x}N$.

Referring now to FIG. 3, a pictorial view of a device for producing photons in the near to ultraviolet wavelength from impinging electrons is shown. The device comprises an anode, a cathode, a substrate 11 and an epitaxial layer of aluminum gallium nitride 14. The cathode is electrically biased at a negative potential voltage relative to the anode, this biasing is advantageously about 2000 volts. The substrate 11 is a single crystalline sapphire ($Al_2O_3$) substrate having a substantially planar major surface. A thin film epitaxial layer of aluminum gallium nitride $Al_x Ga_{l-x}N$) 14 is grown over the major surface and is electrically connected to the positive side of the bias supply. The value of x can be any value between 0 and 1. The $Al_x Ga_{l-x}N$ epitaxial layer is preferably in the thickness range of about 100 nm to 1000 nm.

Figure 4:
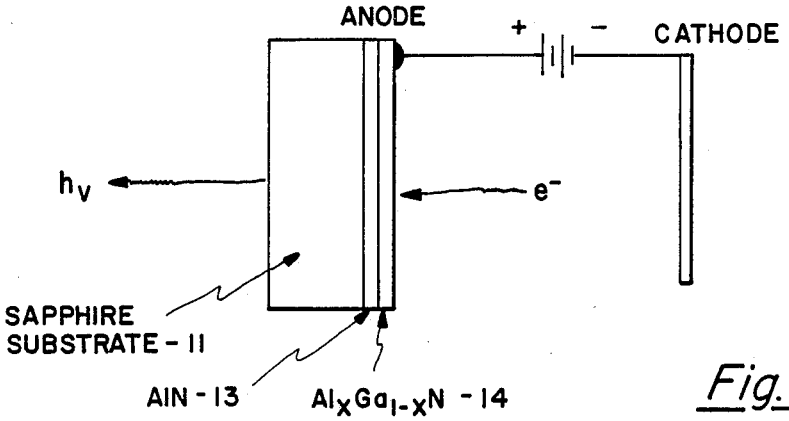
FIG. 4 is an alternate embodiment of a device for producing photons from impinging electrons including an additional layer of aluminum nitride (AlN) grown on the surface of the substrate.

Referring now to FIG. 4, an alternate embodiment of a device for producing photons in the near to ultraviolet wavelength from impinging electrons is shown. The device is similar to the device in FIG. 3 with the addition of a second epitaxial layer of aluminum nitride (AlN) 13 interposed between the substrate 11 and the first epitaxial layer of $Al_x Ga_{l-x}N$ 14. The second epitaxial layer of AlN 13 is preferably about 0.1 micron in thickness. In general, the devices as shown in FIGS. 3 and 4 operate as follows. An electron impinges on the $Al_x Ga_{l-x}N$ layer 14 exciting the phosphor. This causes optical emission. The emitted radiation exits the substrate in the form of a photon having a wavelength in the ultraviolet range. The emission wavelength is, in general, determined by the selected phosphor. In the basic case it is determined by the alloy composition of $Al_x Ga_{l-x}N$. The emission wavelength selected may be in the range of 220 nm to 360 nm.

While there has been shown and described a preferred embodiment of the invention, those skilled in the art will appreciate that various changes and modifications may be made to the illustrated embodiment without departing from the true spirit and scope of the invention which is to be determined from the appended claims.

The embodiments of the invention in which an exclusive property or right is claimed are defined as follows:

1. A pulsed optical source adapted to be connected to an external power source, comprising:

photon emitting means for emitting photons;

first converting means for converting photons into photoelectrons disposed to receive photons emitted from the photon emitting means;

means for multiplying and emitting the photoelectrons in the form of a pulsed cloud of electrons, the multiplying and emitting means having input and output terminals and being disposed to receive electrons from the first converting means;

second converting means for converting electrons into photons disposed to receive the pulsed cloud of electrons from the multiplying and emitting means;

acceleration means for accelerating the pulsed cloud of electrons from the multiplying and emitting means to the electron converting means, the accelerating means comprising a voltage source having a first terminal and a second terminal wherein the first terminal is at a negative electrical potential with respect to the second terminal, and the first terminal is connected to the output terminal of the multiplying and emitting means and the second terminal is connected to the electron converting means so that the emitted pulsed cloud of electrons is accelerated to the electron converting means;

control means for controlling the duty cycle of the multiplying and emitting means having a first terminal connected to the input terminal of the multiplying and emitting means and a second terminal connected to the first converting means for converting photons into photoelectrons; and biasing means having a first terminal and a second terminal wherein the first terminal is at a positive electrical potential with respect to the second terminal, and the first terminal is connected to the output terminal of the multiplying and emitting means and the second terminal is connected to the input terminal of the multiplying and emitting means.

2. The apparatus of claim 1 wherein the photon emitting means is a low level radiation tritium activated phosphor comprised of tritium gas and a phosphor contained within a chamber.

3. The appratus of claim 1 wherein the photon converting means comprises a photocathode.

4. The appratus of claim 1 wherein the second conversion means for converting electrons into photons comprises a phosphor coated anode.

5. The apparatus of claim 1 wherein the second conversion means for converting electrons into photons comprises an $Al_x Ga_{l-x}N$, where $0<x<1$, alloy composition grown in an epitaxial layer over a sapphire substrate.

6. The apparatus of claim 1 wherein the means for multiplying and emitting means comprises a high gain microchannel plate electron multiplier.

7. The apparatus of claim 1 wherein the duty cycle means emits a pulsed electric signal which comprises a pulse with an amplitude of about at least 200 volts, a pulse width in the range of about 100 ns to 1000 ns and a repetition rate in the range of about 10 to 100 pps.

8. The apparatus of claim 5 wherein the $Al_xGa_{l-x}N$ film has a thickness in the range of about 100 nm to 1000 nm.

9. The apparatus of claim 6 wherein the multiplying and emitting means emits electrons in the range of about $10^6$ to $10^7$ times per duty cycle pulse.

10. The apparatus of claim 7 wherein the number of photons emitted from the optical source is in the range of about $10^{13}$ to $10^{15}$ per pulse.

11. The apparatus of claim 7 wherein the emission wavelength of the optical source is in the range of about 200 nm to 360 nm.

12. The apparatus of claim 11 wherein the spectral bandwidth is in the range of about 10 nm to 15 nm.

13. The apparatus of claim 1 wherein the biasing means has a potential voltage of about 1000–2500 volts.

14. Apparatus for producing photons in the near to ultraviolet wavelength from impinging electrons comprising:

an anode;

a cathode biased at a lower potential voltage relative to the anode;

a single crystalline sapphire ($Al_2O_3$) substrate having a substantially planar major surface; and a thin film epitaxial layer of aluminum gallium nitride ($Al_x Ga_{l-x}N$) grown over said major surface where $0<x<1$ is greater than 0, the film being electrically connected to the anode.

15. The apparatus of claim 14 wherein the $Al_x Ga_{l-x}N$ epitaxial layer is in the thickness range of about 100 nm to 1000 nm.

16. The apparatus of claim 14 additionally comprising a second epitaxial layer of AlN interposed between the substrate and the first epitaxial layer of $Al_x Ga_{l-x}N$.

17. The apparatus of claim 16 wherein the first epitaxial layer of $Al_x Ga_{l-x}N$ is in the thickness range of about 100 nm to 1000 nm and the second epitaxial layer of AlN is in the thickness range of about 0.1 micron.

18. An optical source adapted to be connected to an external power supply comprising:

means for emitting electrons having input and output electrodes;

means for controlling the duty cycle and quantity of electrons emitted by the emitting means by pulsing the emitting means on and off, the controlling means having a first terminal connected to the input electrode of the emitting means and a second terminal connected to the output electrode of the emitting means wherein the first terminal is set at a negative electrical potential with respect to the second terminal when the emitting means is switched on by the controlling means; and means for converting electrons to photons wherein the converting means maintains a positive electric potential in reference to the first converting means and is located in a position suitable to receive the electrons emitted by the emitting means.

19. The apparatus of claim 18 wherein the means for emitting electrons is a self-activating microchannel plate.

20. The apparatus of claim 18 wherein the means for controlling the quantity of electrons emitted and the duty cycle of the emitting means comprises an electrical circuit which emits a pulsed electrical signal further comprising a pulse with an amplitude in the range of about 1000–2500 volts, a pulse width in the range of about 100 ns to 1000 ns and a repetition rate in the range of about 10 to 100 pps.

21. The apparatus of claim 18 wherein the means for converting electrons to photons comprises an $Al_xGa_{l-x}N$ where $0<x<1$, film having a thickness in the range of about 100 nm to 1000 nm.

22. The apparatus of claim 18 wherein the means for emitting electrons emits electrons at a rate in the range of about $10^6$ to $10^7$ per duty cycle pulse.

23. The apparatus of claim 18 wherein the number of photons emitted from the optical source is in the range of about $10^{13}$ to $10^{15}$ per duty cycle pulse.

24. The apparatus of claim 18 wherein the emission wavelength of the optical source is in the range of about 200 nm to 360 nm.

25. The apparatus of claim 24 wherein the spectral band width is in the range of about 10 nm to 15 nm.

26. The apparatus of claim 23 additionally including means for focusing emitted photons.

27. The apparatus of claim 18 additionally including means for focusing emitted photons.

* * * * *

UNITED STATES PATENT AND TRADEMARK OFFICE

CERTIFICATE OF CORRECTION

PATENT NO. : 4,967,089

DATED : October 30, 1990

INVENTOR(S) : Reilly, David M., et al.

It is certified that error appears in the above-identified patent and that said Letters Patent is hereby corrected as shown below:

Column 6, Line 4 delete the word "means".

Column 6, Line 66 delete the phrase "first converting means" and replace it with -- output electrode of the emitting means --.

Column 7, Line 15 delete the phrase "where $0 < x < 1$, film" and replace it with -- film, where $0 < x < 1$, --.

Signed and Sealed this

Twenty-sixth Day of May, 1992

*Attest:*

DOUGLAS B. COMER

*Attesting Officer*

*Acting Commissioner of Patents and Trademarks*